US005425259A

United States Patent [19]

Coben et al.

[11] Patent Number: 5,425,259

[45] Date of Patent: Jun. 20, 1995

[54] FORMING MACHINE FOR BENDING METAL STRIPS

[76] Inventors: Lawrence F. Coben, 27003 Belcher Hill Rd., Golden, Colo. 80403; Bruce E. Meyer, 17837 W. Lunnonhaus Dr., Apt. #4, Golden, Colo. 80401

[21] Appl. No.: 909,362

[22] Filed: Jul. 6, 1992

[51] Int. Cl.[6] ..... B21D 5/08

[52] U.S. Cl. ..... 72/181

[58] Field of Search ..... 72/181, 180, 182, 178, 72/176, 226, 238

[56] References Cited

U.S. PATENT DOCUMENTS

| | | | |
|---|---|---|---|
| 2,826,235 | 3/1958 | Gudmestad | 72/178 |
| 3,319,448 | 5/1967 | Bottom | 72/176 |
| 3,529,461 | 9/1970 | Knudson | 72/181 |
| 3,595,056 | 7/1971 | Hutton | 72/181 |
| 3,815,398 | 6/1974 | McClain | 72/181 |
| 4,487,046 | 12/1984 | Abbey | 72/178 |
| 4,716,754 | 1/1988 | Youngs | 72/181 |
| 4,787,233 | 11/1988 | Beymer | 72/181 |
| 4,899,566 | 2/1990 | Knudson | 72/181 |
| 4,947,671 | 8/1990 | Lindstrom | 72/181 |
| 5,148,694 | 9/1992 | Pearson | 72/181 |

*Primary Examiner*—Daniel C. Crane
*Attorney, Agent, or Firm*—Timothy J. Martin

[57] ABSTRACT

A metal forming machine is adapted to bend flat strips of metal into a desired profile. The machine has a rigid framework that forms a cage in which a drive mechanism is disposed to advance a strip therethrough. An elongated rail structure is secured within the cage's interior and is removable out of one of the entrance or exit of the framework. Preferably, the rail structure is mounted at selected discrete mounting locations spaced laterally of the drive mechanism. A plurality of forming elements are disposed on the rail structure to define at least two longitudinally spaced forming stations, and the forming stations act to bend the strip into the desired profile. The rail structure may be removed from the framework without detaching the mounting stations. A plurality of rail structures may be employed with some of the rail structures formed by a plurality of longitudinally aligned rail sections at least one of which carries a plurality of forming stations. Alternative sets of rail structures may be interchangeably mounted in the framework as forming sets to allow formation of different profiles without individually changing each forming station. Mounting blocks may adjustably interconnect the rail structures to the framework. The drive mechanism can incorporate a plurality of pairs of coacting rollers, and a shear mechanism may cut the formed strip at desired lengths.

23 Claims, 7 Drawing Sheets

FORMING MACHINE FOR BENDING METAL STRIPS

FIELD OF THE INVENTION

The present invention generally relates to metal forming machines, but more particularly relates to metal forming machines wherein a strip of metal is advanced through the machine against metal forming elements which progressively shape the strip of metal into a desired cross-sectional configuration. The field of this invention specifically concerns improvements to the mounting structure used to secure the forming elements within the machine so that different sets of forming elements may be interchanged to configure various profiles.

BACKGROUND OF THE INVENTION

Metal fabricating machines occupy a significant role in modern industry and include, for example, machines which stamp, roll, form, cut and extrude metal, to name a few. One such type of a machine, and a type to which the present invention is directed, receives an elongated strip of metal at an entryway, advances the strip of metal progressively through the machine and against the laterally positioned forming elements to configure the longitudinal margins of the strip into desired useful cross-sections after which the strip is discharged at an exit location. The metal strips fed into such a machine may either be discreet lengths of metal or, as is more typically the case, a continuous feed is provided from a coil, and the formed strip is cut into usable lengths at the exit location. Specific examples of such machines for which the present invention is particularly useful include gutter, roof panel and siding panel forming machines.

Existing panel forming machines have a framework structure which houses a drive system for advancing the strip of metal therethrough and machined forming elements are disposed to configure the longitudinal margins of the strip. Normally in these machines, the profile forming elements are each independently mounted to the framework at selected locations so that the longitudinal margin of the strip is progressively bent into a desired profile. While these existing machines are quite useful and effective in fabricating metal strips into panels and gutters, each machine typically can only form a single profile so that a fabricator must acquire a separate machine for each profile desired to be configured. Alternately, the entire set of forming elements may be replaced by individually detaching each forming element; thus, it is possible to produce a different profile. Naturally, this procedure is very time consuming and costly to the fabricator. Since a variety of different profiles are desired by various purchasers, interchanging the elements on an individual basis is not suitable so that the fabricator again reverts to the purchase of a variety of machines.

Even where individual forming elements are replaced, the fabricator still is constrained to produce panels of a set width since the forming elements are each attached to discrete positions. Thus, where a fabricator wishes to manufacturer custom widths, or a variety of standard widths, additional machines must be acquired or extensive modifications must be made to an existing machine. Neither of these solutions is desirable from the fabricator's standpoint both for monetary costs and time considerations.

Accordingly, prior to the present invention, there was an unresolved need for improvements to metal fabricating machines of a type to form profiles and strips of materials. One area of need was to have a more universal machine which could replace a variety of other machines each specially designed to create a specific profile in a metal strip. Another need was to provide fabricators the ability to change panel widths having desired longitudinal edge profiles with a minimum effort and down time for the forming machine. There was a further need for a metal forming machine that was enhanced in this versatility without adding inordinately to the capital cost of the machine.

SUMMARY OF THE PRESENT INVENTION

It is an object of the present invention to provide a new and useful metal forming machine specifically adapted for creating profiles one or more of the longitudinal margins of a strip of metal.

It is a further object of the present invention to provide a metal forming machine wherein different sets of forming elements may be inserted and removed from the machine as a single unit or as groups whereby different profiles may be fabricated onto a longitudinal edge margin of a metal strip.

Yet another object of the present invention is to provide a metal forming machine which can bend opposite longitudinal margins of a strip of metal into desired profiles separated by width that is easily adjustable whereby different panel widths may be produced with the same family of forming elements.

Still a further object of the present invention is to provide a new and improved mounting structure for the forming elements of a metal forming machine which provides adjustable positioning of the forming elements as a set.

A further object of the present invention is to provide a metal forming machine which may be easily transported to on-site locations.

According to the broad form of the present invention, a metal forming machine is provided to bend a longitudinally margin of a flat strip of metal into a desired profile. The strip of metal may either be a selected length strip or a continuous strip that is fed into the machine and severed at desired lengths. In either event, the broad form of the present invention employs a rigid framework which extends about a forming region through which the flat strip may be advanced from an upstream entrance to a downstream exit. A drive mechanism is disposed in the forming region and mounted to the framework so that the drive mechanism can engage the flat strip and advance the strip in the downstream direction. An elongated rail structure is adapted to be removably secured in the mounted state to the framework in the forming region so that it is located alongside the drive mechanism and spaced a selected lateral distance therefrom. Forming elements are secured to the elongated rail structure and define at least two forming stations located in longitudinally spaced relation to one another. These forming stations are positioned to receive the longitudinal margin of the flat strip when the rail structure is in the mounted state so that the forming stations are operative to bend the longitudinal margin into the desired profile. The rail structure is detachable from the framework so as to remove all of the forming stations secured thereto without detachment of the forming stations from the rail structure itself. With this configuration, alternative rail structures may be separately mounted within the framework with these alternative rail structures having different forming stations thus allowing fabrication of different profiles with the same basic machine.

Due to weight considerations, it is preferred that the rail structure is formed of at least two rail sections which may be longitudinally aligned with one another. In this case, each rail section has at least some of the forming stations therein and at least one of the rail sections has at least two of the forming stations. Further according to the preferred embodiment of the present invention, the rail structure is mounted for lateral adjustment of position to vary the width between the rail structure and the drive mechanism thereby allowing variation of the width of the formed panel having the desired profile.

Preferably, first and second rail structures are provided with there being rail structure on either side of the drive mechanism so that both of the opposite longitudinal margins of the strip of metal may be simultaneously configured into a selected profile. In this case, it is preferred that each of the rail structures includes a plurality of mounting stations secured thereto so that one set of mounting stations may be interchanged with another set of mounting stations by simply removing each of the rail structures. In this configuration, it is desired that both of the rail structures be adjustable laterally so that the width of the fabricated panel may be selectively varied. Again, one or both of the rail structures may be constructed as a plurality of rail sections.

While the improvement in the rail structure carrying the forming elements may be implemented with a variety of drive mechanisms and framework mechanisms for existing metal forming machines, in the preferred embodiment of the present invention, the drive mechanism includes a plurality of pairs of coacting rollers disposed in the forming region at spaced locations from one another. Here, each pair of coacting rollers operates to frictionally engage opposite surfaces of the flat strip of metal with a gripping force such that counter-rotation of the pair of coacting rollers advances the flat strip in the downstream direction. A drive linkage accordingly interconnects these pairs of coacting rollers for corresponding rotational movement, and adjusting screws are provided so that the gripping force may be selectively varied in magnitude. Further, in order to power the machine, it is preferred that the power source be in the form of a hydraulic drive coupled to a combustive engine with the combustive engine driving a hydraulic pump connected to a reservoir of fluid. The pump in turn powers a hydraulic motor that in turn powers the drive mechanism to advance the metal strip through the forming region past the forming elements. Where a continuous feed is provided, a shearing mechanism is disposed proximately to the exit and is operative when activated to transversely cut the strip of metal after the profile is formed to produce a formed piece having a selected length.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a metal forming machine specifically adapted to bend one or both of the longitudinal margins of a flat strip of metal into a desired profile. While the present invention may be employed with elongated strips of metal sheet cut to discreet lengths, it is contemplated that the present invention may be primarily used with a continuous feed structure wherein formed strips having a desired longitudinal profile are cut out of a continuous strip of material fed into the forming machine. Specifically, the present invention is constructed to receive a variety of different sets of metal forming elements mounted as sets on rail structures so that the different sets may be easily interchanged to allow fabrication of different panel profiles. To this end, it should be understood that the phrase "panel" when used in the context of a formed strip can include, for example, a standing seam panel, siding, guttering, structural or non-structural framing members and the like, as would be understood by the ordinarily skilled person in this metal forming art.

Figure 1:
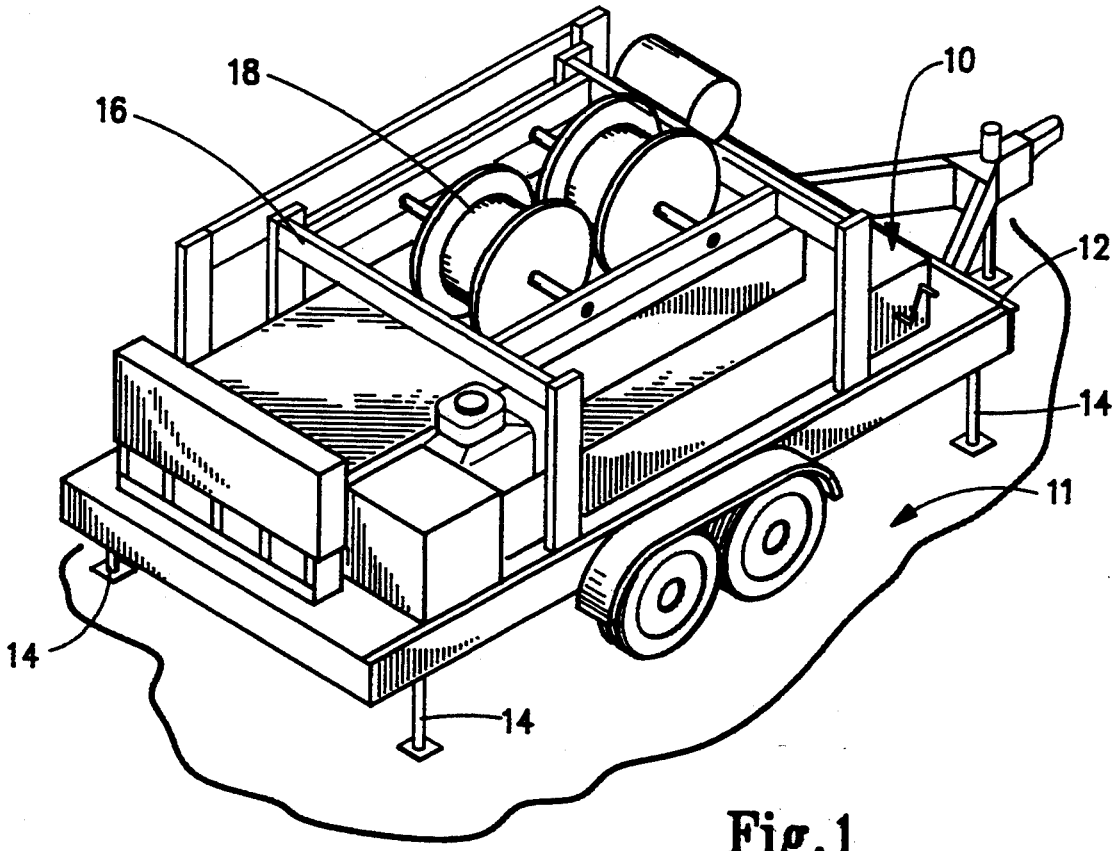
FIG. 1 is a rear view in perspective showing the metal forming machine according to an exemplary embodiment of the present invention showing the metal forming machine mounted on a trailer for transport.

The metal forming machine according to the exemplary embodiment of the present invention is best shown, in its broad structure, in FIGS. 1–4. In FIG. 1, it may be seen that metal forming machine 10 is adapted to be mounted onto a trailer structure 12 which may be towed to an on-site location and positioned on surface 11 and stabilized thereto by means of stabilizing lifts 14. Trailer 12 is provided with a spool frame 16 which shows a pair of spools 18 mounted for rotation thereon. Spools 18 are adapted to receive coils of sheet metal which may be fed into metal forming machine 10, as described more thoroughly below.

Figure 2:
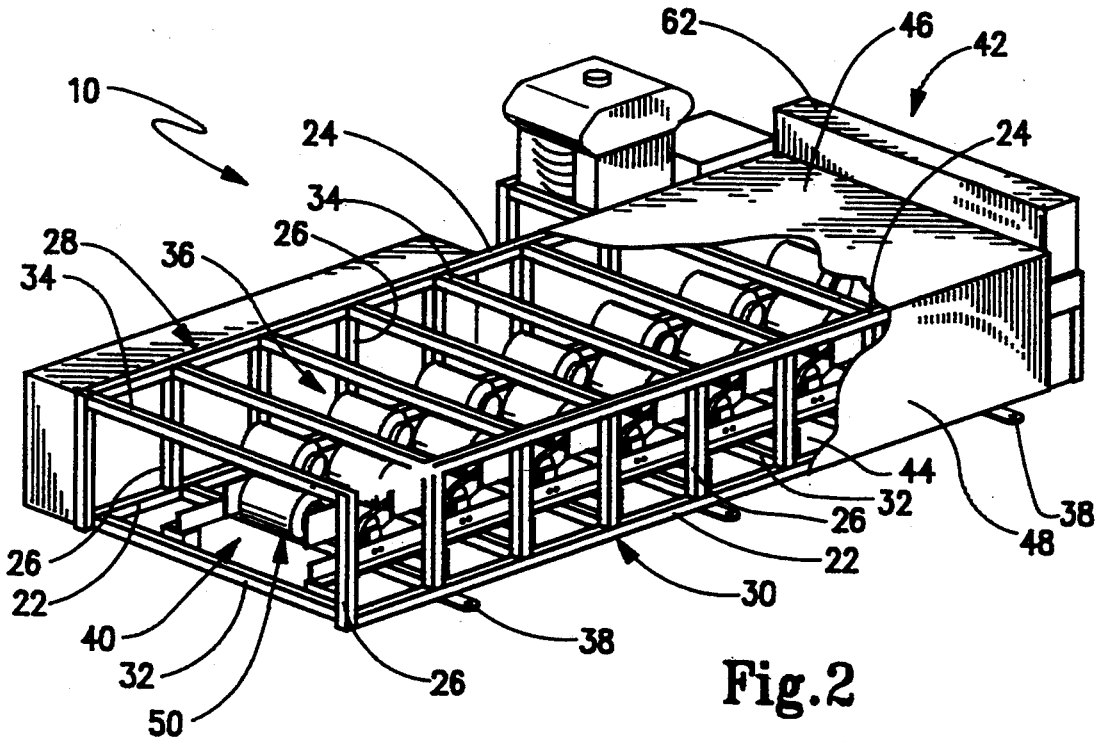
FIG. 2 is a front view in perspective, partially broken away, showing the metal forming machine of FIG. 1.
Figure 3:
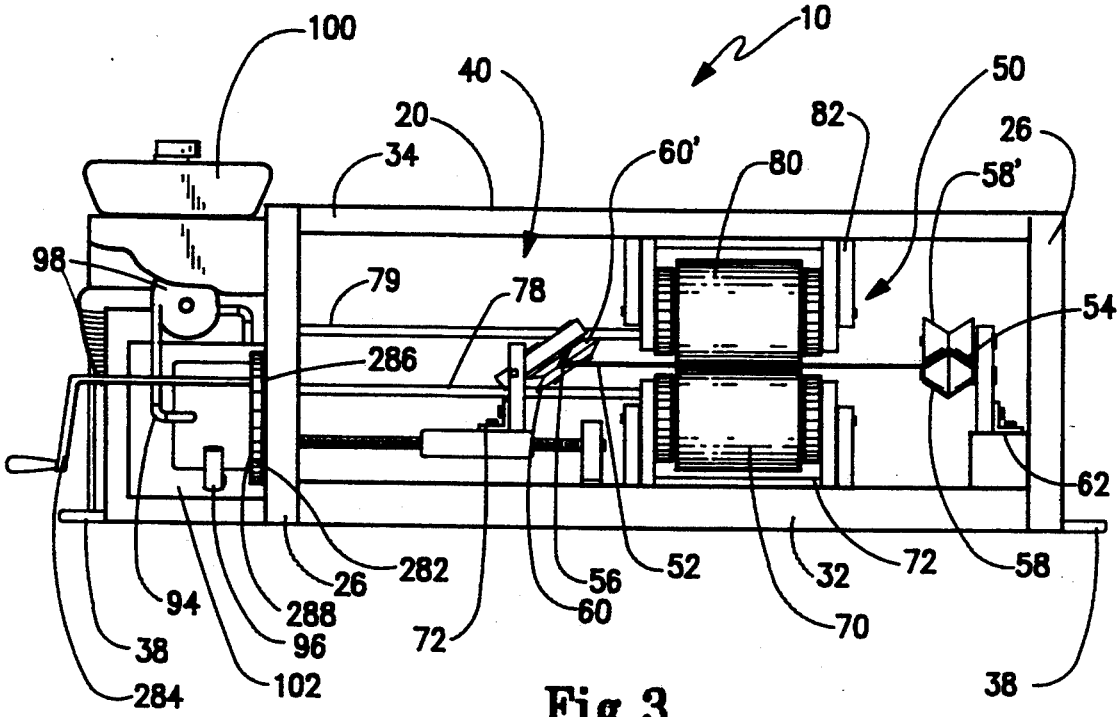
FIG. 3 is a front view in elevation, partially broken away, showing the metal forming machine of FIGS. 1 and 2.
Figure 4:
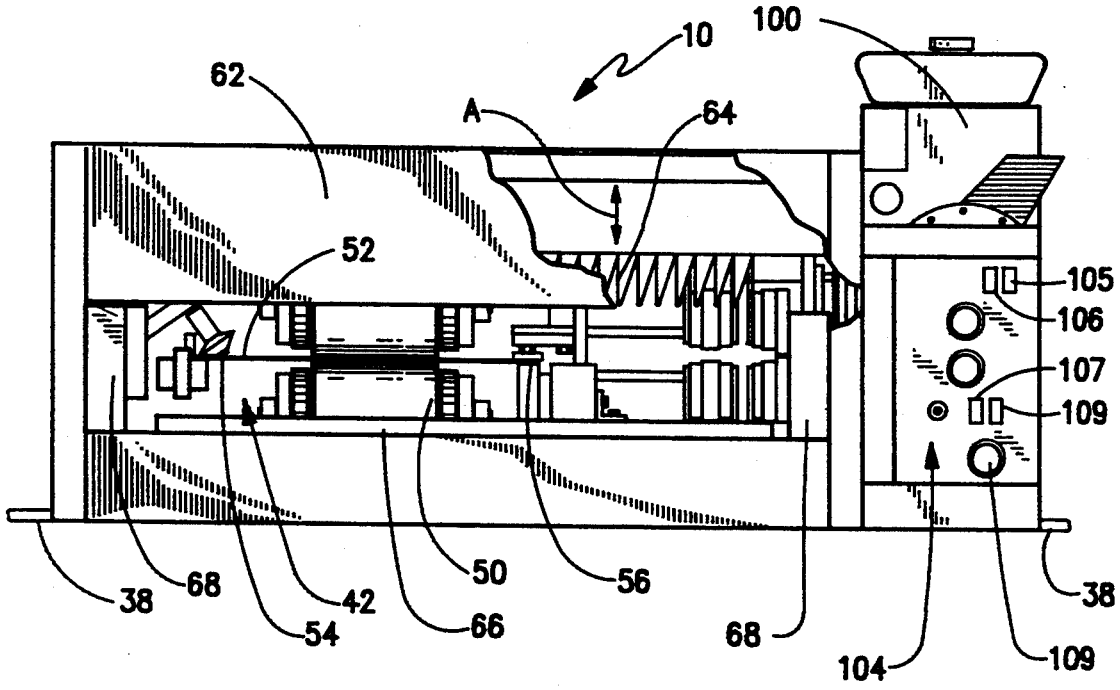
FIG. 4 is a rear view in elevation, partially broken away, showing the metal forming machine of FIGS. 1 and 2.

As is shown in FIGS. 2–4, metal forming machine 10 is in the form of a rigid framework 20 formed by a pair of lower longitudinal members 22 and a pair of upper longitudinal members 24 which are rigidly interconnected to lower longitudinal members 22 by a plurality of vertical members 26 to form side frames 28 and 30 on the left and right sides of metal forming machine 10, respectively. Side frames 28 and 30 are rigidly interconnected to one another by lower transverse members 32 and upper transverse members 34 so that framework 20 forms a rigid cage which extends around a generally longitudinal forming region 36 through which a strip of metal to be formed may be passed, and framework 20 includes a plurality of ears 38 so that framework 20, and thus forming machine 10, may be rigidly attached to trailer 12. Each of members 22, 24, 26, 32 and 34 are preferably tubular steel of square-shape cross-section. Forming region 36 defines an entrance 40 and an exit 42 and is surrounded by bottom panel 44, top panel 46 and side panels 48, all of which are attached, such as by screws, to framework 20 so as to enclose forming region 36 other than at entrance 40 and exit 42.

A drive mechanism 50 is disposed in forming region 36 in order to advance the strip of metal in a downstream direction from entrance 40 to exit 42. Drive mechanism 50 is mounted to framework 20, as described below, and is operative to engage a flat strip, such as strip 52 shown in FIGS. 3 and 4, in order to advance the strip through forming region 36. As is shown in FIGS. 3 and 4, metal strip 52 has opposite longitudinal margins 54 and 56 which are to be formed by forming elements. To this end, a plurality of forming elements, such as forming elements 58, 58' and 60, 60', are organized into forming stations that are disposed in forming region 36. These forming elements are respectively secured to first and second rail structures 140 and 240, by suitable mounts, also as described more thoroughly below. A shearing mechanism 62 is provided at exit 42 in order to sever strip 52 into desired sections after the marginal profiles are formed thereon. Shearing assembly 62 is of a type well-known in the art as guillotine and is hydraulically actuated by hydraulic cylinders 68. Activation of shearing assembly 62 reciprocates knives 64 in the direction of arrow "A" against base block 66.

Figure 5:
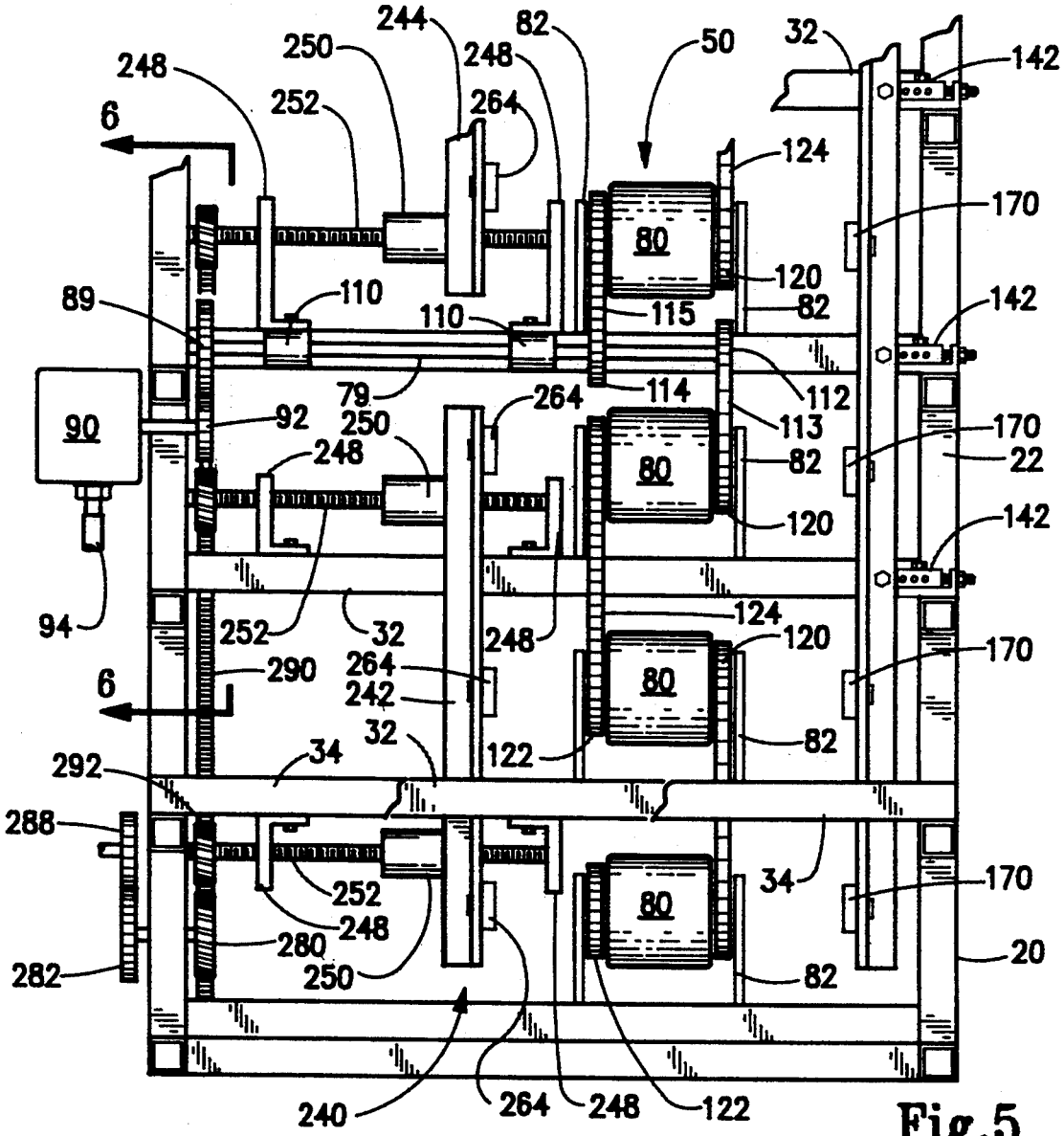
FIG. 5 is a top plan view, partially broken away, showing the framework, drive mechanism and rail structure of the metal forming machine shown in FIGS. 1–4.
Figure 6:
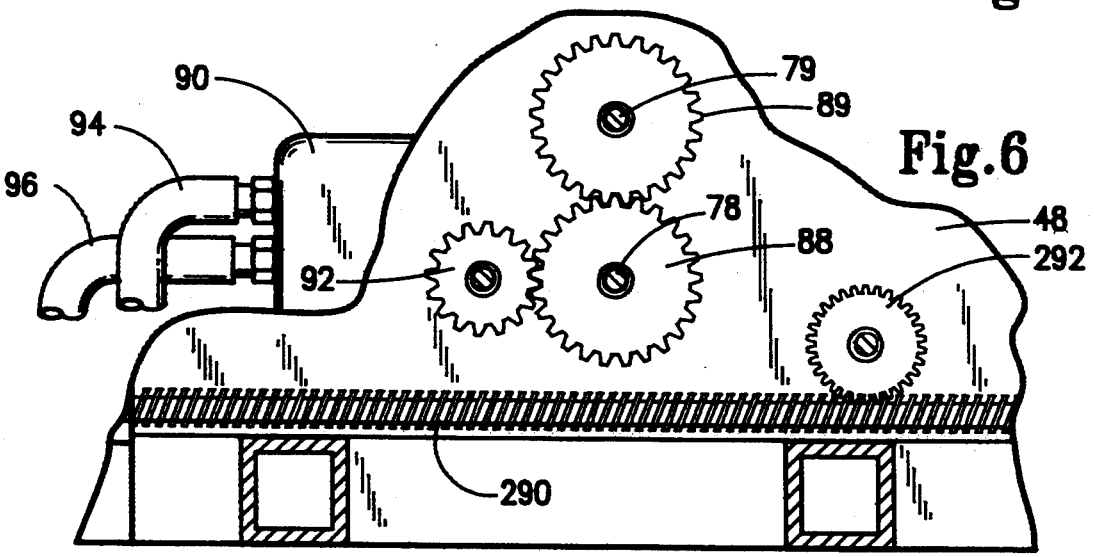
FIG. 6 is a side view, in partial cross-section, taken about lines 6—6 of FIG. 5.

As is shown best in FIGS. 2–7, drive mechanism 50 is formed by a plurality of pairs of coacting rollers which counter-rotate in order to advance the strip of metal through the forming region 36. Here, a lower roller 70 and upper roller 80 which are respectively secured to transverse members 32 and 34 by bracket assemblies 72 and 82. Rollers 70 each has a central metal core 74 surrounded by a rubber-like gripping material 76 to increase the frictional engagement of roller 70 with metal strip 52. Likewise, each roller 80 includes a central metal core 84 surrounded by a rubber-like surface 86. Drive mechanism 50 is powered by rotating drive rods 78 and 79 which are driven by way of a hydraulic motor 90 acting through drive gear 92 which engages gear 88 secured to drive rod 78. Gear 88 engages another gear 89 so that, upon rotation of drive gear 92, gears 88 and 89 counter-rotate thereby counter-rotating drive rods 78 and 79 in corresponding directions. Hydraulic motor 90 is driven by hydraulic fluid which circulates through entry conduit 94 and exit conduit 96. Hydraulic fluid is pumped by means of pump 98 which is powered by gasoline engine 100. Pump 98 circulates hydraulic fluid out of a reservoir 102 and through the hydraulic motor 90 so that the fluid returns to reservoir 92, as best shown in FIGS. 3 and 6. Furthermore, as is best shown in FIG. 4, a control panel 104 is provided which includes start and stop buttons 105, 106 for hydraulic motor 90 and activate and deactivate buttons 107, 108 for cutting assembly 62. An emergency stop button 109 is also provided to deactivate all operation of metal forming machine 10 in case of emergencies.

Figure 7:
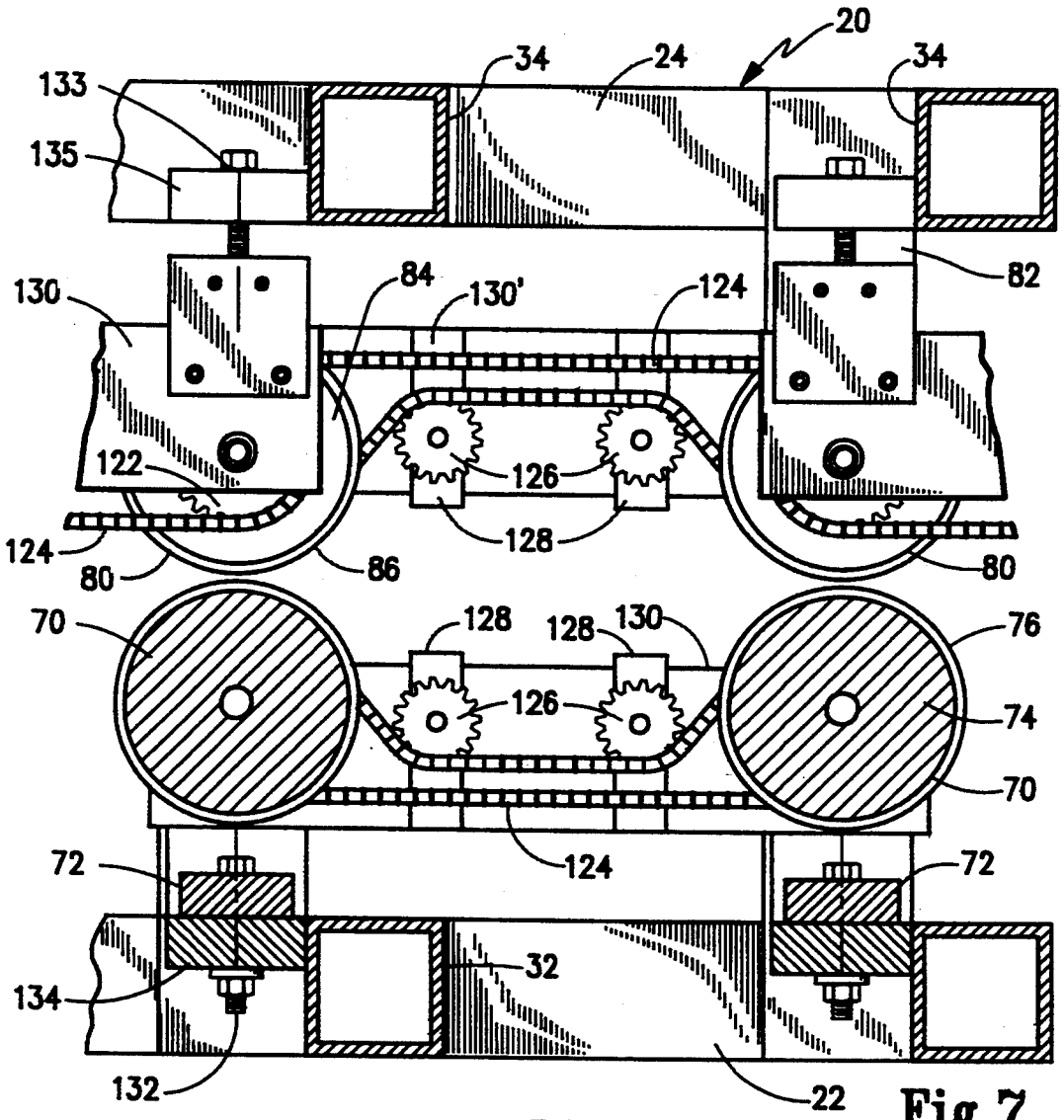
FIG. 7 is a side view, in partial cross-section, showing a portion of the drive mechanism used for the exemplary metal forming machine of FIGS. 1–4.
Figure 13A:
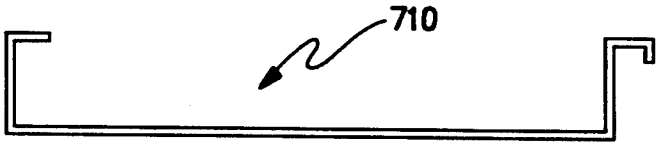
FIGS. 13(*a*) through 13(*d*) show representative panel profiles which may be configured by forming elements mounted in the metal forming machine of the present invention.
Figure 13B:
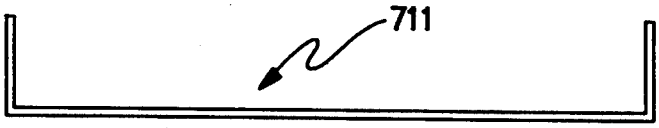
Figure 13C:
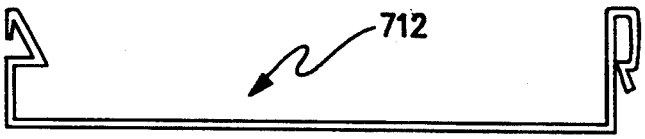
Figure 13D:
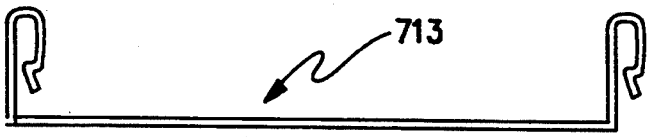

With reference to FIG. 5, it may be seen that rotation of drive rods 78 and 79 operate to counter-rotate rollers 70 and 80. To this end, for example, drive rod 79 is supported by bearings 110 mounted to framework 20 and include a pair of drive gears 112, 114 which engage primary drive chains 113 and 115, respectively. Thus, as is shown in FIG. 5, primary drive chain 113 drives upper roller 80' by way of drive gear 120. Drive chain 115 drives upper roller 80 by way of gear drive 122. Transfer drive chains 124 transfer this rotary motion between adjacent ones of rollers 70 and 80 by driveably interconnecting gears 120 and 122, respectively, as is best shown in FIG. 7. In this figure, it may be seen that interconnecting drive chains 124 may be tensioned by idler gears 126 rotatably journaled on brackets 128 which are in turn secured to connecting plates 130, 131' which interconnect adjacent ones of roller pairs 70 and 80. Connecting plates 130, 131' are mounted by brackets 72 and 82. Lower plate 130 is rigidly mounted to lower frame member 32 through block 134 by bolt 132. Upper plate 130' is supported by adjusting bolt 133 mounted through block 135 secured to upper transverse frame members 34. This allows the gripping force between a pair of rollers 70, 80 to be adjustably varied.

From the foregoing description, it may be appreciated that each pair of rollers 70 and 80 may be positioned for different thicknesses of metal strips by adjusting bolts 132 and 133 which moves brackets 172 and 182 away from and toward one another. After properly positioning rollers 70 and 80, the tension of interconnecting drive chains 124 may be adjusted by adjustably positioning idler bracket 128 so that idler gears 126 take up the slack in chains 124.

An important feature of the present invention resides in the mounting of the forming elements which operate to bend the longitudinal margins of a strip of metal passing through drive mechanism 50 into a selected profile. Contrary to the teachings of prior art structures, the present invention employs elongated rail structures to mount the forming elements in sets so that a plurality of forming stations are located on the guide rails and so that these forming stations may be secured within framework 20 as sets without requiring each individual forming element to be independently mounted. Thus, as is seen in FIG. 5, a first rail structure 140 is mounted to framework 20 by means of slide mounting blocks 142, best shown in FIGS. 8 and 9, and a second rail structure 240 is mounted to framework 20 by means of rods 252, slide blocks 250 and channel pieces 246, best shown in FIGS. 10 and 11.

Figure 8:
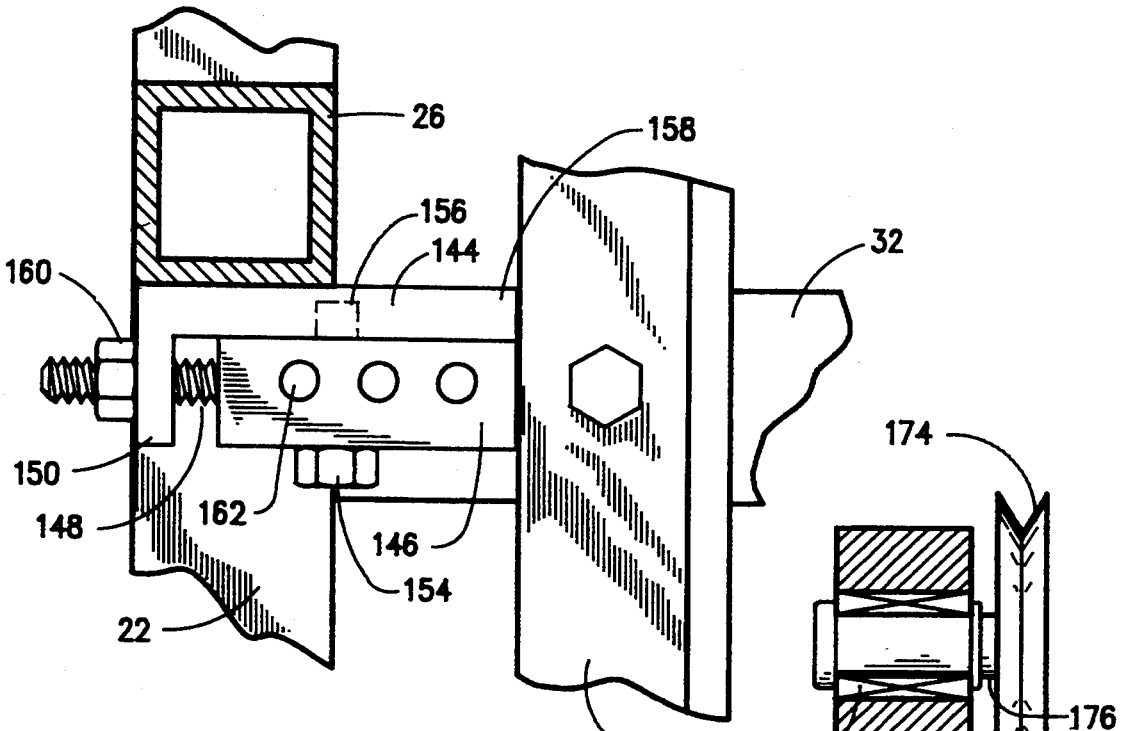
FIG. 8 is a top plan view of the mounting block structure for a first rail structure for the metal forming machine of FIGS. 1–4.
Figure 9:
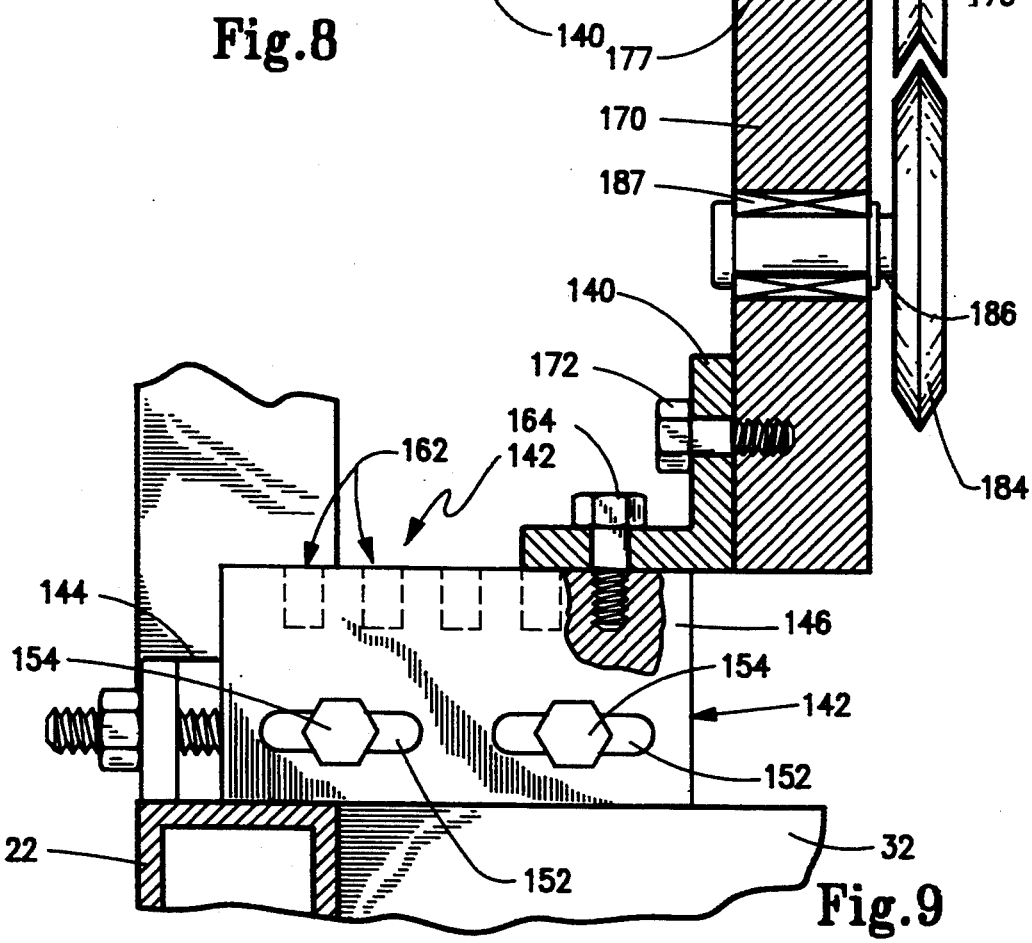
FIG. 9 is an end view, in partial cross-section, showing the first rail mounting structure of FIG. 8 along with an exemplary pair of forming elements.

In FIGS. 8 and 9, it may be seen that mounting blocks 142 include an L-shaped arm 144 having legs 150 and 158. Arm 144 is rigidly secured to lower transverse member 132 and lower longitudinal member 22 and a slide plate 146 carries a threaded rod 148 which is received through a bore in the leg 150 of arm 144. Slide plate 146 is provided with a pair of slots 152 which receive bolts 154 that are threadably received in bores 156 of leg 158. Nut 160 is received on rod 148 so that slide plate 146 may be relatively moved with respect to L-shaped arm 144 by loosening bolts 154 and by adjusting nut 160. Bolts 154 are then tightened to lock plate 146 to arm 144. Slide plate 146 includes a plurality of threaded openings 162 which then receive bolts 164 that mount first rail structure 140 to slide plate 146. Accordingly, rail structure 140, which is preferred to be in the shape of an angle iron, may be secured in a desired bore 162 for lateral adjustment at discrete intervals after which slide plate 146 may be adjusted relative to arm 144 providing infinite adjustment for the position of rail structure 140 within the range of openings 162 and 152.

Rail structure 140 mounts rigid plates 170 by means of bolts 172, and plates 170 rotatably receive forming elements, such as forming elements 174 and 184 respectively on axles 176 and 186 journaled in bearings 177 and 187. Accordingly, each plate 170 and its associated forming elements defines a single forming station through which the longitudinal margin of sheet 52 may be driven thereby to bend the margin into a desired profile. With reference again to FIG. 2, it may be seen that a plurality of forming stations defined by plates 170 are secured to a single rail 140.

Figures 10, 11:
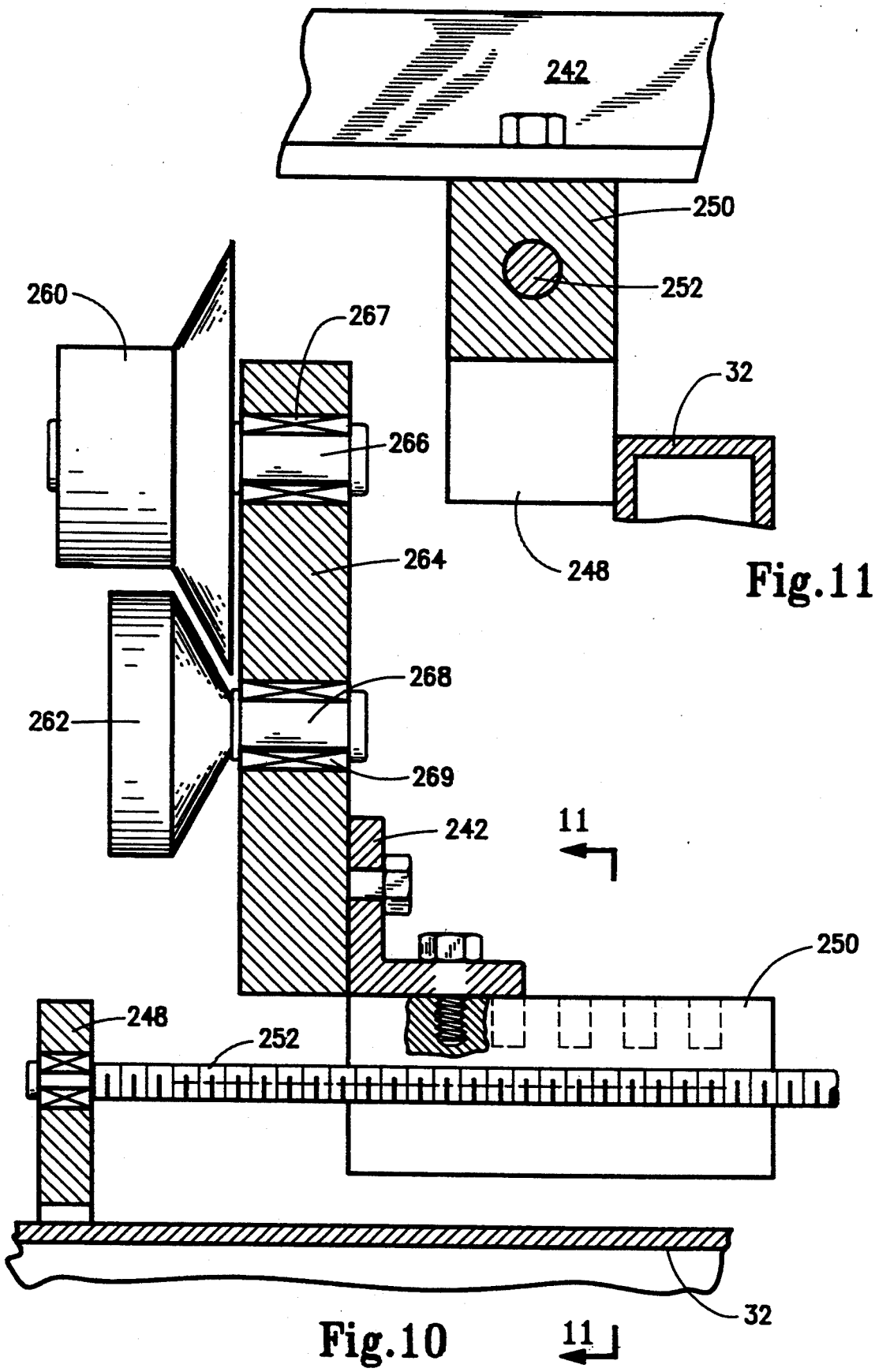
FIG. 10 is a rear view in elevation, in partial cross-section, showing the mounting structure for a second rail structure for the metal forming machine of FIGS. 1–4 along with a second pair of metal forming elements.
FIG. 11 is a cross-sectional view taken about lines 11—11 of FIG. 10.

A second rail structure 240 is shown in FIG. 5 and includes first and second rail sections 242 and 244. Each of sections 242 and 244 are slidably mounted with respect to framework 20. To this end, each of rail sections 242 and 244 has its ends mounted to a traveling block 250 which is threadably received on a threaded drive rod 252. Each of rods 252, in turn, are rotatably journaled between mounting blocks 248 that are rigidly attached to lower transverse frame members 32. This mounting structure is further shown in FIGS. 10 and 11, and it may be readily be appreciated that, as rods 252 are rotated, the travel blocks 250 are driven transversely to the downstream direction and carry with them the second guide rail structure 240, as defined by rail pieces 242 and 244 and, correspondingly, the forming elements secured thereto. Thus, for example, as is shown in FIG. 10, forming elements 260 and 262 are secured to rail section 242 by means of a mounting plate 264 and axles 266 and 268. Axles 266 and 268 are respectively received in bearings 267 and 269 mounted through plate 264.

In order to rotate each of rods 252 so that each slide block 250 is correspondingly driven, a bevel drive gear 280 is provided that is driven by shaft 282 that may be operated by hand crank 284 shown in FIG. 3 which turns drive gear 286 that rotates transfer gear 288. With reference again to FIGS. 5 and 6, it may be seen that drive gear 280 rotates spiral threaded rod 290; rod 290 in turn operates a bevel drive gear 292 connected to each of rods 252. Accordingly, when crank 284 is rotated, each traveling block 250 is slid back and forth a common distance.

Figures 12A, 12B:
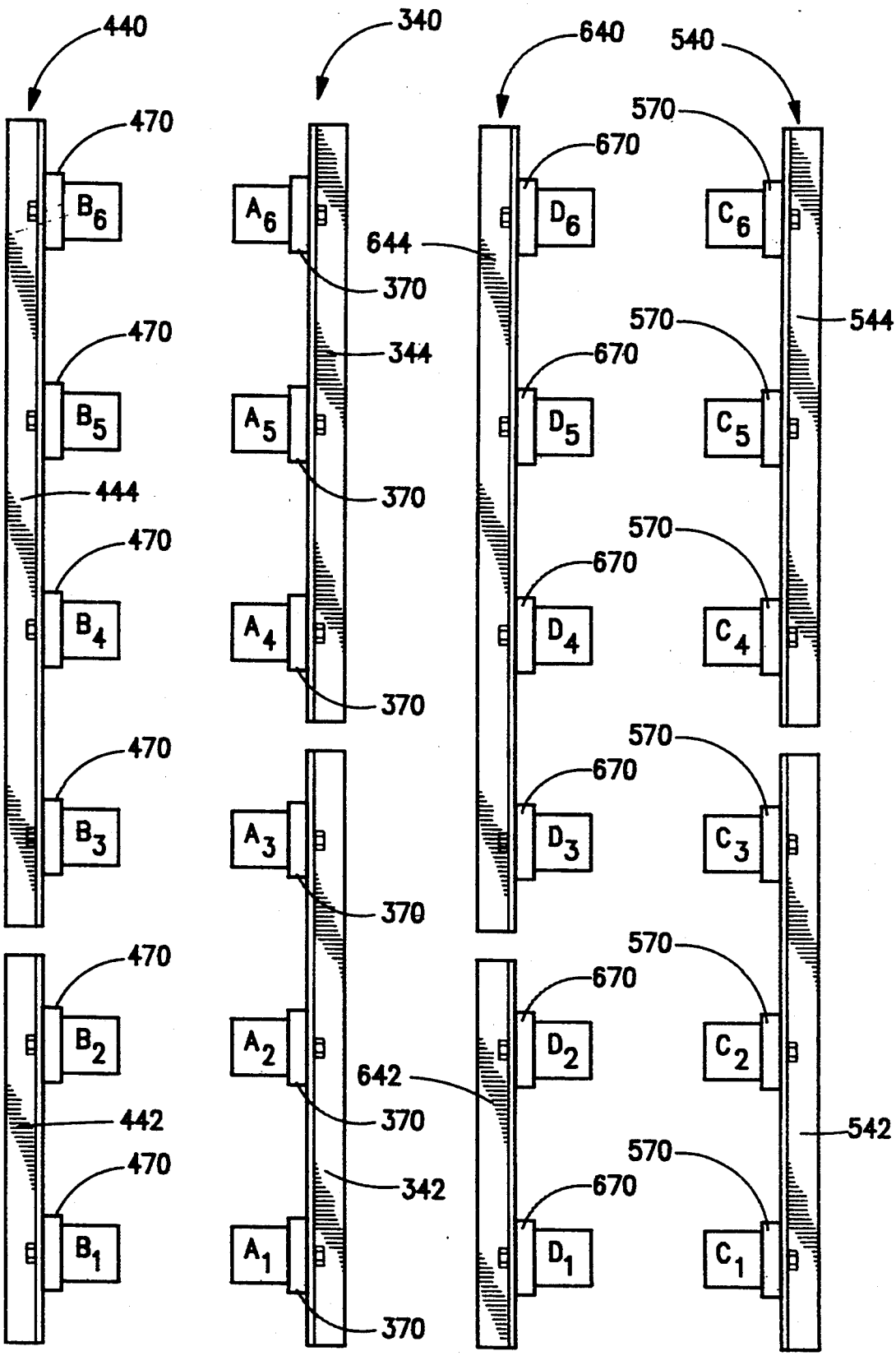
FIGS. 12(*a*) and 12(*b*) show alternate rail structures for use with the metal forming machine of FIGS. 1–4.

With reference to FIGS. 12(*a*) and 12(*b*), it should be appreciated that each rail structure carries a plurality of forming stations mounted thereon and that alternative rail structures may be interchanged to provide different forming stations whereby different edge profiles may be fabricated. For example, as is shown in FIG. 12(*a*), a first rail structure 340 includes a first rail section 342 and a second rail section 344 which may be longitudinally aligned with one another. Rail section 342 carries forming stations A1–A3 on respective mounting blocks 370 while rail section 344 carries forming stations A4–A6 on mounting blocks 370. Removal of rail sections 342 and 344 would allow removal all of forming stations A1–A6 without removing the forming stations from the respective rail section. Similarly, second rail structure 440, shown in FIG. 12(*a*), is formed of two rail sections 442 and 444. Rail section 442 carries a pair of forming stations B1 and B2 respectively mounted on plates 470 while rail section 444 carries a plurality of forming stations B3–B6 on mounting plates 470. Again, removal of each of rail sections 442 and 444 allows removal of all of forming stations B1–B6 from the forming region. Likewise in FIG. 12(*b*), first rail structure 540 has aligned rail sections 542 and 544 which respectively mount forming stations C1–C3 and C4–C6; second rail structure 640 has aligned rail sections 642 and 644 which mount forming stations D1–D2 and D3–D6, respectively, on plates 570 and 670.

It should now be appreciated with the structure described above, alternative sets of forming elements may be removed from the forming machine 10 without detaching the respective pairs of forming elements that define the forming stations from the respective rails. Therefore, a fabricator may fabricate different profiles by using different sets of first and second rail structures without the need to use a different forming machine. That is, the various forming elements that define the forming stations may be inserted and removed from the machine as easily mounted sets without removing those forming elements from their respective rails. Since the attachment of each rail is accomplished by simply bolting the rail to its respective mounting block, such as mounting blocks 146 and slide blocks 150, very little time is necessary to complete this process.

With reference to FIGS. 13(*a*)–13(*d*), a variety of known profiles 710, 711, 712 and 713 are shown which can be manufactured by a single machine simply by exchanging the rail structures. To this end, the ordinarily skilled engineer in this field can design the forming elements to create these and other profiles. It should further be understood that the width of each of these profiles may be changed merely by turning crank 284 to expand or contract the relative distance between the first and second rail structures.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A metal forming machine adapted to bend a longitudinal margin of a flat strip of metal into a desired profile, comprising:

(a) a rigid framework having side frames rigidly interconnected to one another by transverse members to form a rigid cage having an interior; said cage extending about a forming region through which said flat strip may be advanced from an upstream entrance to a downstream exit;

(b) a drive mechanism disposed in the interior of said rigid cage in the forming region and mounted to said framework, said drive mechanism operative to engage said flat strip and advance said flat strip in a downstream direction from said entrance to said exit;

(c) an elongated rail structure adapted to be removably secured within the interior of said cage in a mounted state to said framework in the forming region thereof at discrete first mounting locations whereby said first rail structure may be secured at selected discrete locations spaced a selected lateral distance from said drive mechanism; and (d) a plurality of forming elements secured to said rail structure to define at least two forming stations located in a longitudinally spaced relation to one another along said rail structure, said forming stations positioned to receive said longitudinal margin when said rail structure is in the mounted state whereby said forming stations are operative to bend said longitudinal margin into the desired profile as said flat strip is advanced through the forming region by said drive mechanism, said rail structure being detachable from said framework and removable from the forming region without detachment of said forming stations therefrom.

2. A metal forming machine according to claim 1 wherein said rail structure is formed as at least two rail sections, each said rail section having at least some of said forming elements secured thereto such that at least one of said rail sections has a plurality of forming stations located thereon and other ones of said rail sections have at least one first forming station located thereon.

3. A metal forming machine according to claim 2 wherein said rail sections are longitudinally aligned with one another.

4. A metal forming machine according to claim 1 wherein said rail structure is adjustably secured with respect to said framework whereby the lateral distance between said drive mechanism and said rail structure may be selectively varied.

5. A metal forming machine according to claim 4 wherein said rail structure has opposite first rail ends and including means for adjusting the lateral distance between said rail structure and said drive mechanism by moving said rail structure as a unit such that the opposite ends are commonly advanced toward and retracted away from said drive mechanism.

6. A metal forming machine according to claim 1 including mounting blocks interconnecting said framework and said rail structure, each said mounting blocks having a plurality of mounting locations at which said rail structure may be secured whereby the lateral distance between rail structure and said drive mechanism may be discreetly adjusted.

7. A metal forming machine according to claim 6 wherein each said mounting block is adjustably connected to said framework whereby the lateral distance between said rail structure and said drive mechanism may be continuously adjusted over a selected range.

8. A metal forming machine according to claim 1 including a shearing mechanism disposed proximately to said exit and operative when activated to transversely cut said strip of metal after said profile is formed to produce a formed piece having a selected length.

9. A metal forming machine according to claim 1 wherein said drive mechanism includes a plurality of pairs of coacting rollers disposed in the forming region at spaced locations from one another, each pair of coacting rollers operative to frictionally engage opposite surfaces of said flat strip with a gripping force whereby counter rotation of said pair of coacting rollers advances said flat strip in the downstream direction.

10. A metal forming machine according to claim 9 including drive linkage driveably interconnecting each pair of coacting rollers for corresponding rotational movement.

11. A metal forming machine according to claim 9 wherein said gripping force may be adjustably varied in magnitude.

12. A metal forming machine according to claim 1 including a power source operative to power said drive mechanism.

13. A metal forming machine according to claim 12 including a source of hydraulic fluid, a pump, and a hydraulic motor and wherein said power source is a combustive engine whereby said engine powers said hydraulic pump which in turn powers said hydraulic motor that powers said drive mechanism.

14. A metal forming machine according to claim 1 including a plurality of alternative rail structures each of which may be selectively secured to and detached from said framework, each said alternative rail structure having forming elements organized to provide at least two forming stations thereon, each of said alternative rail structures having forming elements different from others of said alternative rail structures whereby said alternative rail structures may be interchanged to permit fabrication of selected different profiles.

15. A metal forming machine adapted to bend opposite first and second longitudinal margins of a flat strip of metal to form a panel piece having a desired profile, comprising:

(a) a rigid framework extending about a forming region through which said flat strip may be advanced from an upstream entrance to a downstream exit;

(b) a drive mechanism disposed in the forming region and mounted to said framework, said drive mechanism operative to engage said flat strip and advance said flat strip in a downstream direction from said entrance to said exit;

(c) an elongated first rail structure adapted to be removably secured in a mounted state to said framework in the forming region thereof alongside said drive mechanism on a first side thereof by first mounting blocks interconnecting said framework and said first rail structure, each said first mounting block having a plurality of first discrete mounting locations whereby said first rail structure may be secured at selected first lateral distance from said drive mechanism;

(d) an elongated second rail structure adapted to be removably secured in a mounted state to said framework in the forming region thereof alongside a second side thereof side drive mechanism and on a second side thereof by second mounting blocks each said second mounting block having a plurality of second discrete mounting locations whereby said second rail structure may be secured at a selected second lateral distance from said drive mechanism;

(e) a plurality of first forming elements secured to said first rail structure and organized to provide at least two first forming stations located in a longitudinally spaced relation to one another along said first rail structure, said first forming stations positioned to receive a first longitudinal margin of said strip when said first rail structure is in the mounted state whereby said first forming stations are operative to bend said longitudinal margin into a first desired edge profile as said flat strip is advanced through the forming region by said drive mechanism, said first rail structure being detachable from said framework and removable from the forming region without detachment of said first forming stations therefrom; and (f) a plurality of second forming elements secured to said second rail structure and organized to provide at least two second forming stations located in a longitudinally spaced relation to one another along said second rail structure, said second forming stations positioned to receive a second longitudinal margin of said strip when said second rail structure is in the mounted state whereby said second forming stations are operative to bend said longitudinal margin into a second desired edge profile as said flat strip is advanced through the forming region by said drive mechanism, said second rail structure being detachable from said framework and removable from the forming region without detachment of said second forming stations therefrom.

16. A metal forming machine according to claim 15 wherein each said first mounting block is adjustably connected to said framework whereby the lateral distance between said first rail structure and said drive mechanism may be continuously adjusted over a selected range.

17. A metal forming machine according to claim 15 wherein said second rail structure is adjustably secured with respect to said framework whereby the second lateral distance between said drive mechanism and said second rail structure may be selectively varied.

18. A metal forming machine according to claim 17 wherein said second rail structure has opposite second rail ends and including means for adjusting the second lateral distance between said first rail structure and said drive mechanism by moving said second rail structure as a unit such that the opposite second rail ends are commonly advanced toward and retracted away from said drive mechanism.

19. A metal forming machine according to claim 18 wherein said means for adjusting the second lateral distance includes a threaded rod disposed transversely in said forming region and a traveling block slidably supported on each said threaded rod for reciprocal movement therealong and a drive assembly operative to move each of said traveling blocks in conjunction with one another whereby said slide blocks are subjected to common reciprocal movement, said second rails being secured to said traveling blocks.

20. A metal forming machine according to claim 15 wherein each of said first and second rail structures is formed of at least two rail sections, such that said first rail structure has a plurality of first rail sections each having at least some of said first forming elements secured thereto and such that said second rail structure has a plurality of second rail sections each having at least some of said second forming elements secured thereto whereby at least one of said first rail sections has a plurality of first forming stations located thereon and whereby at least one of said second rail sections has a plurality of second forming stations located thereon.

21. A metal forming machine according to claim 15 wherein at least one of said first and second rail structures is formed as at least two rail sections, each said rail section having at least some of the respective said first and second forming elements secured thereto such that at least one of said rail sections has a plurality of forming stations located thereon and other ones of said rail sections have at least one forming station located thereon.

22. A metal forming machine according to claims 21 wherein said first rail sections are longitudinally aligned with one another and wherein said second rail sections are longitudinally aligned with one another when in the mounted state.

23. A metal forming machine adapted to bend a longitudinal margin of a flat strip of metal into a desired profile, comprising:

(a) a rigid framework having side frames rigidly interconnected to one another by transverse members to form a rigid cage surrounding an interior extending about a forming region through which said flat strip may be advanced from an upstream entrance to a downstream exit;

(b) a drive mechanism disposed in the forming region interiorly of said rigid cage and mounted to said framework, said drive mechanism operative to engage opposite surfaces of said flat strip and advance said flat strip in a downstream direction from said entrance to said exit;

(c) an elongated rail structure adapted to be removably secured in a mounted state to said framework in the forming region interiorly of said rigid cage alongside said drive mechanism and spaced a selected lateral distance therefrom; and (d) a plurality of forming elements secured to said first rail structure to define at least two forming stations each comprising at least a pair of said forming elements, said forming stations located in a longitudinally spaced relation to one another along said rail structure and positioned to receive said longitudinal margin when said rail structure is in the mounted state whereby said forming stations are operative to bend said longitudinal margin into the desired profile while maintaining a flat central portion of said flat strip of metal as said flat strip is advanced through the forming region by said drive mechanism, said rail structure being demountable from said framework and removable from the forming region out of one of said entrance and said exit without detachment of said forming stations therefrom.

* * * * *